US005996235A

United States Patent [19]

Brainerd

[11] Patent Number: 5,996,235

[45] Date of Patent: Dec. 7, 1999

[54] ICE AXE

[75] Inventor: Charles Brainerd, Salt Lake City, Utah

[73] Assignee: Black Diamond Equipment, Ltd., Salt Lake City, Utah

[21] Appl. No.: 09/015,539

[22] Filed: Jan. 29, 1998

[51] Int. Cl.[6] ..... B26B 23/00

[52] U.S. Cl. ..... 30/308.1; 30/340; 30/342; 7/159; 7/167

[58] Field of Search ..... 30/308.1, 340, 30/342; 7/159, 167; D8/76, 80

[56] References Cited

U.S. PATENT DOCUMENTS

| | | | |
|---|---|---|---|
| 263,104 | 8/1882 | Bickel | 30/308.1 |
| 3,114,973 | 12/1963 | Kennedy | 30/342 |
| 3,712,659 | 1/1973 | Kneissl | 30/308.1 |
| 3,735,434 | 5/1973 | Penberthy | 30/308.1 |
| 4,023,606 | 5/1977 | Knissl | 30/308.1 |
| 5,210,925 | 5/1993 | Morgulis | 30/340 |
| 5,425,176 | 6/1995 | Brainerd et al. | 30/308.1 |

*Primary Examiner*—Hwei-Siu Payer
*Attorney, Agent, or Firm*—Thorpe, North & Western, LLP

[57] ABSTRACT

An ice axe which includes a handle/shaft having a gripping end and a working end, an axe head attached to the working end, and a grip attached to the gripping end. The working end of the handle/shaft is configured with a shorter cross-sectional dimension along an axis parallel to a plane in which the axe would be swung when used. The axe head includes a pick end and an oppositely disposed hammer end, with the hammer end including a sharp ridge protruding generally in the direction of the handle/shaft and transversely thereof so as to allow the hammer end to be used as a hook for ice pockets, rock ledges, etc.

12 Claims, 4 Drawing Sheets

ICE AXE

BACKGROUND OF THE INVENTION

1. Field of the Invention

This invention relates to ice axes used for ice or mountain climbing, and more particularly, to an ice axe which facilitates better penetration and gripping of ice on which the ice axe is used.

2. State of the Art

Ice and mountain climbing entail the extensive use of ice axes for ascending and descending ice, snow and rock, for positioning and driving anchor screws, bolts and pins, and for clearing obstacles. In ice climbing, the strength and safety of given placement depends largely upon getting the tip of the pick portion of the ice axe securely driven into the ice. Bulges in the ice or rock, or other obstacles, can inhibit driving the pick tip securely into the ice.

Attempts to enable driving the pick of an ice axe farther into ice or rock than would normally be possible, has resulted in equipment designers putting an exaggerated bend in the ice axe handle near the pick. That is, some ice axe handles have an exaggerated bend in the direction away from that of the pick, ostensibly to accommodate bulges or other obstacles which might otherwise interfere with the handle and prevent the pick from being driven in sufficiently far. Problems with this approach, however, are that (1) mass (the bend) is placed away from the center axis of the ice axe resulting in a higher rotational moment of inertia and making the axe feel unbalanced and unwieldly, and (2) the rotational center axis typically does not run through the handle at the grip area so it is more difficult keeping the axe in proper alignment for swinging the pick into ice or rock. Of course, it would be desirable to provide an ice axe in which the distance between the extreme tip of the pick and the near surface of the handle is maximized while at the same time configuring the axe such that the center axis thereof extends through the hand grip area of the handle to thus provide greater stability and control in using the ice axe.

Ice axes typically have a hammer head opposite the pick on the axe's working end. This hammer is designed primarily for driving bolts or pins. On conventional ice axes the hammer portion of the axe head is shorter than the pick relative to the center of the axe handle, and typically has a bottom surface that is flat. Additionally, the hammer is often provided with rounded flat side edges surrounding the hitting surface. This configuration causes the hammer head to function poorly as a means of engaging rock or ice and inhibits use of the hammer head for support on small ledges or in small pockets. Because of these concerns, some ice axes have a shorter pick opposite the longer standard pick, instead of a hammer head. While this configuration is useful for shallow depth hooking applications, the utility of a hammer is sacrificed. Thus, the user must choose between the ability to hammer spikes, etc., and the ability to grip in shallow pockets or rock edges.

OBJECTS AND SUMMARY OF THE INVENTION

It is an object of the invention to provide an ice axe which allows superior clearance of the axe shaft for a given length pick, without sacrificing stability.

It is another object of the invention to provide an ice axe which minimizes the distance between the central axis of the handle and the hand grip area of the handle.

It is another object of the invention to provide an axe which minimizes the rotational moment of inertia of the axe about central axis.

It is yet another object of the invention to provide an ice axe that allows for maximum adhesion between the axe head and the handle, and between the hand grip and the handle.

It is a further object of the invention, in accordance with one aspect thereof, to provide an ice axe with hammer head which can be used effectively to hook or hold onto narrow ledges or shallow pockets.

The above and other objects are realized in an ice axe which includes a handle or shaft having a gripping end and a working end, with an axe head attached to the working end and configured for use as an ice axe. The working end of the handle has a cross section with a long axis and a short axis, the short axis being substantially parallel to the plane in which the axe is swung when used, and its long axis being generally perpendicular to the plane of use of the axe.

In accordance with one aspect of the invention, the ice axe includes a hammer head which is configured to facilitate hooking onto rocks and ice. In particular, the hammer head includes a downwardly extending sharpened edge for use as a hook in situations where available rock or ice pocket or ledge is too shallow for use of the pick end of the head.

Other objects and features of the present invention will be apparent to those skilled in the art, based on the following description, taken in combination with the accompanying drawings.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION OF THE PREFERRED EMBODIMENT

Figure 1:
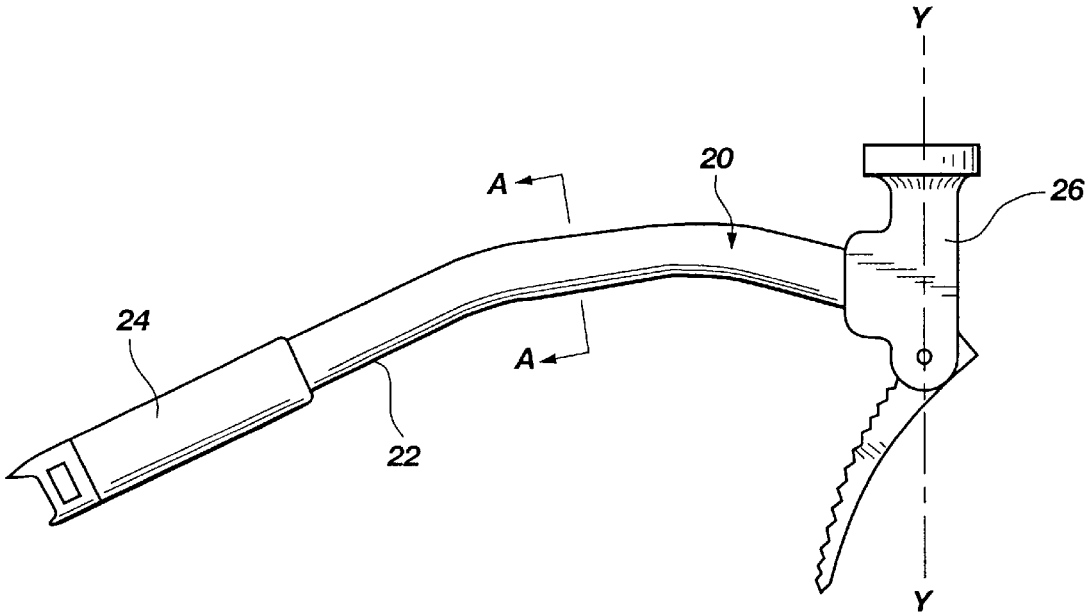
Fig. 1 (PRIOR ART)
FIG. 1 provides a side view of a conventional prior art ice axe.

FIG. 1 is a side view of a conventional ice axe 20, which is generally comprised of a shaft 22, a grip 24, and a head 26. Conventional ice axes may have a curve in the handle as shown, or may have a straight handle. When in use, the ice axe 20 is held manually by the grip 24, so as to allow swinging the head 26 in a plane approximately along axis Y—Y.

Figure 2:
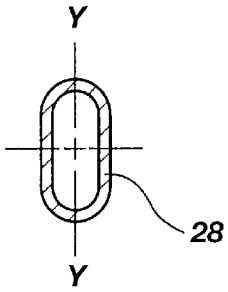
FIG. 2 shows a typical cross-sectional view of the shaft or handle of the conventional ice axe of FIG. 1 taken along line A—A.

FIG. 2 shows a typical cross-sectional view 28 of the handle of the conventional ice axe of FIG. 1 taken along line A—A. In conventional ice axes, this oval configuration is oriented with the large axis substantially parallel to axis Y—Y, and the small axis generally perpendicular to axis Y—Y.

Figure 3:
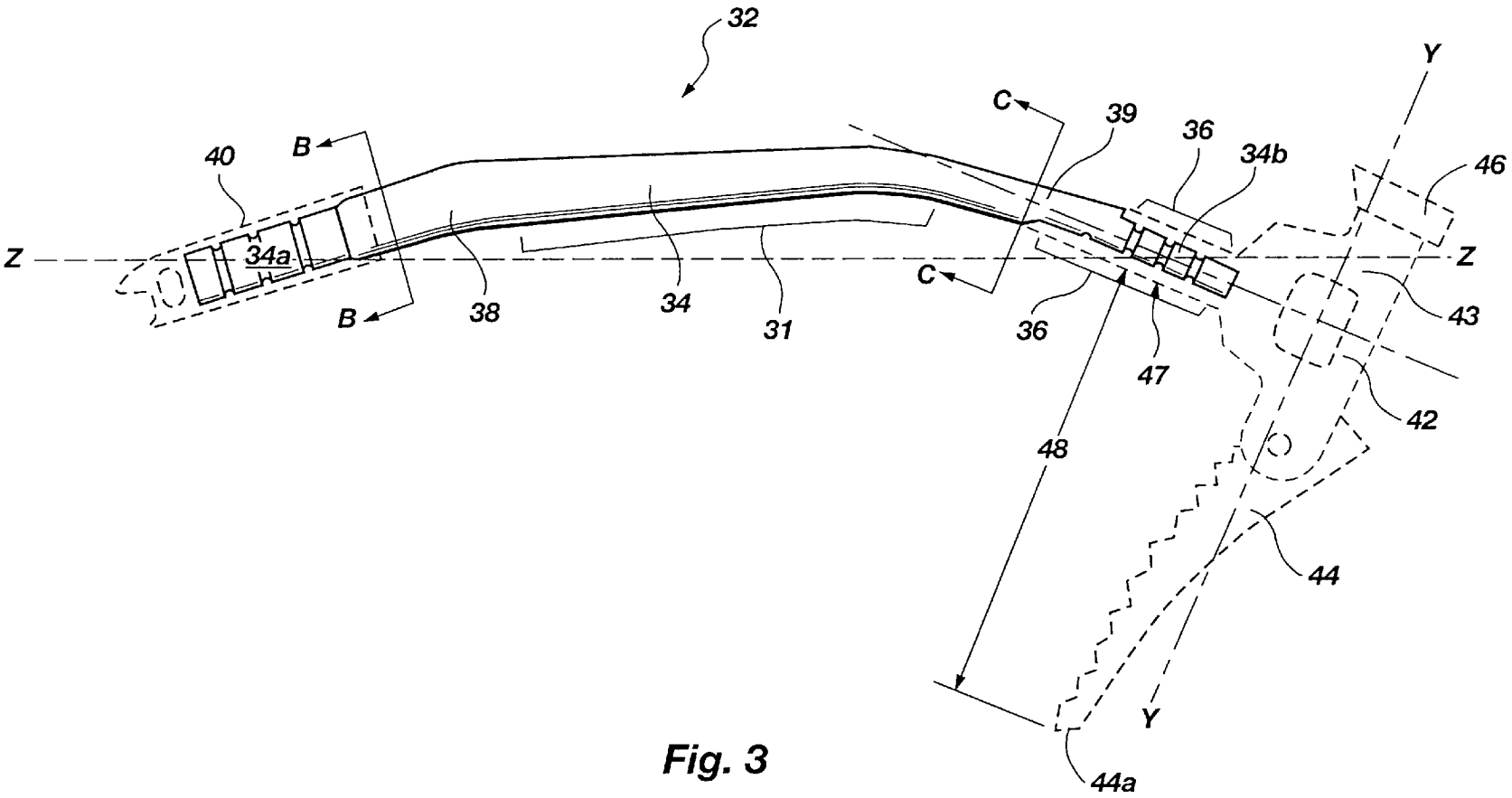
FIG. 3 provides a side view of one embodiment an ice axe made in accordance with of the principles of the present invention.

FIG. 3 shows a side view of one embodiment of an ice axe 32 made in accordance with the present invention, to include a shaft 34 having a gripping end 34*a* and a working end 34*b*. A grip 40 (shown in phantom) is mounted on the gripping end 34*a* of the shaft 34, and axe head 42 (also shown in phantom) is mounted on the working end 34*b* of the shaft. The shaft 34 may be constructed of wood, metal, plastics, composites, or other materials suitable for application of the tool. One material suitable for use as an ice axe shaft is a conventional carbon fiber composite material. When in use, the ice axe 32 is held manually by the grip 40, so as to enable swinging the axe head 42 in a plane approximately along axis Y—Y.

Figure 4:
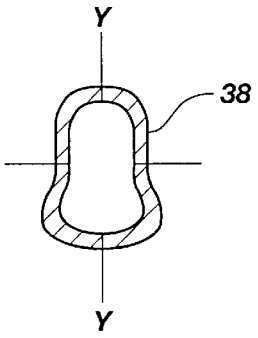
FIG. 4 shows a cross-sectional view near the gripping end of the shaft or handle of the ice axe of FIG. 3 taken along line B—B.

FIG. 4 shows a cross-sectional view of the gripping end 34*a* of the shaft 34 of FIG. 3 taken along line B—B. The gripping end 34*a* of the shaft is enlarged at the bottom, and is oriented with its long axis substantially parallel to axis Y—Y so as to have relatively long sides 38 (see also FIG. 3). This orientation provides a shape that is strong and comfortable to grip.

Figure 5:
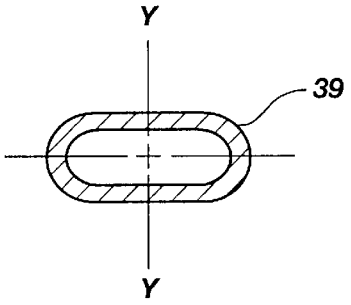
FIG. 5 shows a cross-sectional view near the working end of the shaft or handle of the ice axe of FIG. 3, taken along line C—C.

FIG. 5 shows a cross-sectional view of the working end 34*b* of the shaft 34 taken along line C—C of FIG. 3. The working end 34*b* of the shaft has short sides 39, and is oriented with its long axis perpendicular to axis Y—Y and its short axis parallel to axis Y—Y. The short dimension of the cross section of the working end of the shaft is preferably in the range of 0.75 in. to 1.00 in., and the long dimension of the cross section of the working end of the shaft is in the range of 1.1 in. to 1.5 in., with the ratio of the short dimension to the long dimension preferably being in the range of 1:1.3 to 1:1.6. The shaft 34 changes cross section approximately in the central region 31 of the shaft (FIG. 3). The cross section of the shaft 34 shown in FIGS. 4 and 5 is an improvement over the prior art by providing a greater distance 48 (FIG. 3) between an extreme end 44*a* of a pick 44 of the axe head 42, and the nearest outside surface 47 of the working end 34*b* of the shaft, so as to allow maximum clearance between pick 44 and shaft 34 for a given cross section of the working end 34*b*. This also allows for minimization of the rotational moment of inertia about the central axis Z—Z of the shaft over the conventional configuration.

The grip 40 and the axe head 42 may be anchored to the shaft 34 by chemical adhesives, mechanical fasteners, or any other method suitable for developing a strong, rigid and durable connection. Also shown in the shaft 34 are geometric irregularities formed in the surface of the working end 34*b*, in the regions designated 36, and in the surface of the gripping end 34*a*. These irregularities may comprise grooves (as shown circumferentially in FIG. 3), ridges, dimples, or similar structures for promoting a strong and durable chemical adhesive connection, and may be formed in any location or configuration in the gripping end 34*a* and the working end 34*b* of the shaft 34. These irregularities allow for developing a stronger bond between the grip 40 and axe head 42, to the shaft 34 with chemical adhesives.

Figure 6:
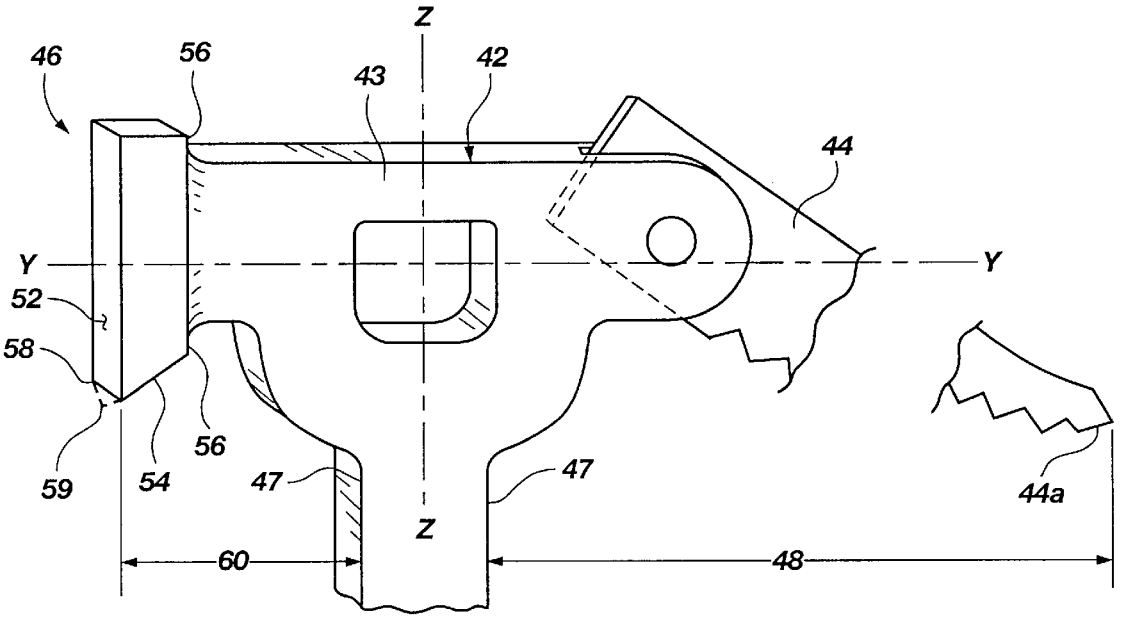
FIG. 6 provides a perspective view of an ice axe head made in accordance with the principles of the present invention.

The axe head 42 is typically made of steel or other strong metal or alloy. The axe head of the present invention, one embodiment of which is depicted in FIG. 6, is comprised of a head 43, a pick 44 and a hammer 46 opposite the pick. The hammer 46 includes a striking face 52, a bottom side 54 and a rear or back 56. In FIG. 6 the bottom side 54 of the hammer end is formed with a sharp front edge 58 at the junction of the striking face 52 and the bottom side 54 of the hammer head, so as to allow the bottom side of the hammer to engage rock or ice in a hooking manner, in addition to its normal use as a hammer. This configuration provides a hooking device which includes a distance 60 between outside surface 47 of the working end 34*b* of the shaft 34 and the striking face 52. This distance 60 is considerably smaller than the distance 48 between the end 44*a* of the pick 44, and the outside surface 47 of the working end 34*b* of the shaft 34. This allows the ice axe to be used for hooking in pockets or on ledges, decreasing the lever arm effect that if the longer pick 44 of the axe were used. This gives greater stability and security.

Figure 7:
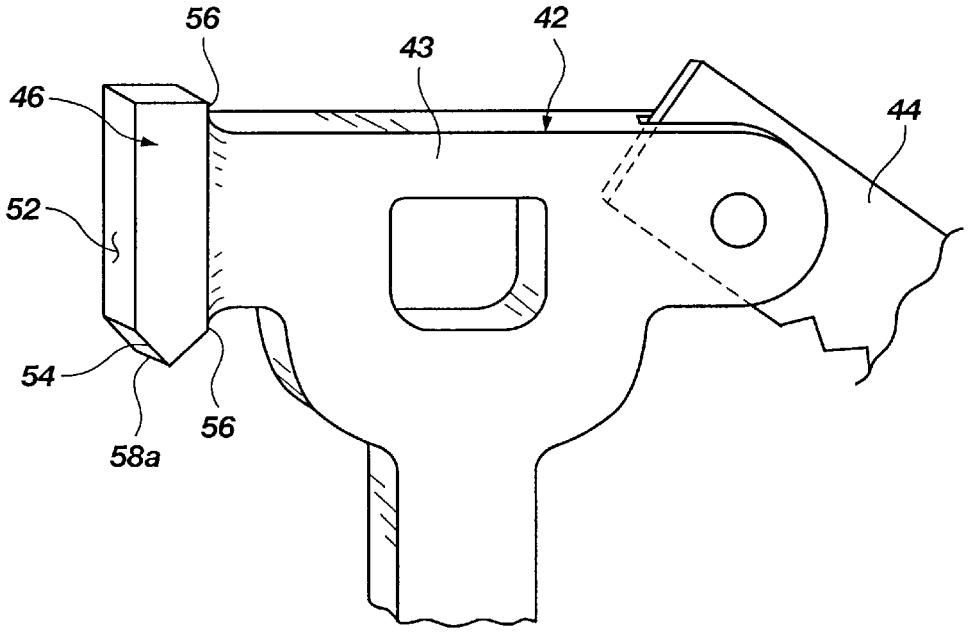
FIG. 7 provides a perspective view of an alternative embodiment of the ice axe head of the present invention.

FIG. 7 depicts an alternative embodiment of the axe head of the present invention wherein a sharp edge 58*a* is formed at the bottom side 54 of the hammer 46, located somewhere between the striking face 52 and the back 56 of the hammer head.

Figure 8:
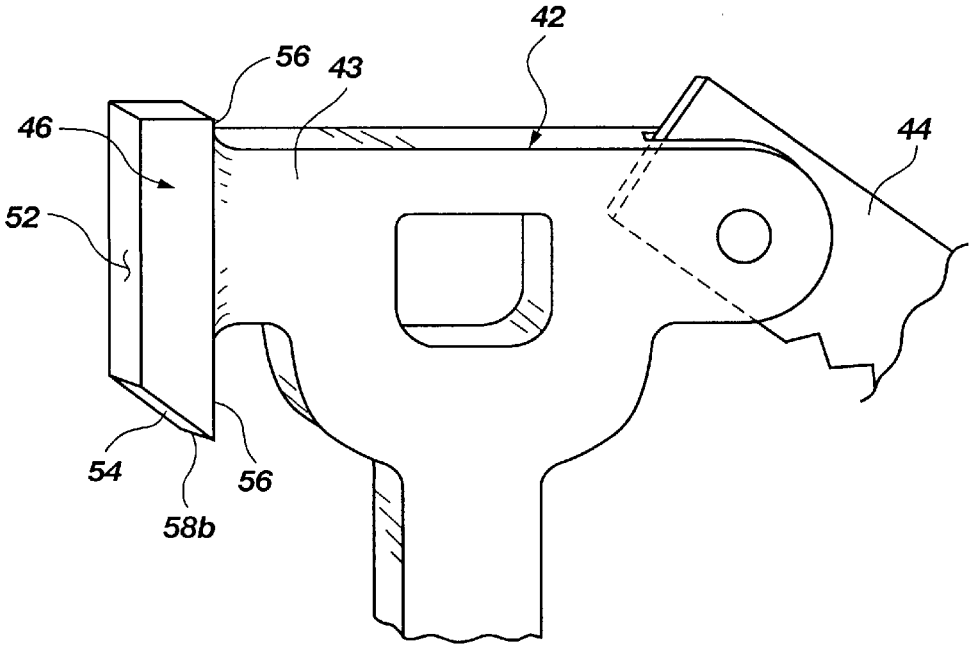
FIG. 8 provides a perspective view of another alternative embodiment of the ice axe head of the present invention.

FIG. 8 illustrates an ice axe head incorporating an additional alternative embodiment of the present invention wherein a sharp edge 58*b* is formed at the bottom side 54 of the hammer 46 and located at the junction of the bottom 54 and the back 56 of the hammer head 46.

As an alternative to the use of sharp edges at the bottom side 54 of the hammer 46, shown in FIGS. 6–8, a sharp point could be employed such as shown by dotted line 59 in FIG. 6.

It will be apparent to those skilled in the art that the various specific embodiments described in this application are merely exemplary of the inventive principles and features of this invention as set forth in the accompanying claims and are not to be viewed as otherwise limiting.

What is claimed is:

1. An ice axe comprising:

a handle comprising a shaft having a gripping end for receiving a grip and a working end;

an axe head attached to the working end of the shaft and configured for use as an ice axe;

said gripping end of the shaft having a cross-section with a long dimension and a short dimension generally transverse of the long dimension, said long dimension being oriented generally parallel to a first axis coincident with the plane in which the axe is swung during use, and said working end of the shaft having a long dimension and a short dimension, said short dimension oriented generally parallel to the first axis, and said long dimension oriented generally transversely of the first axis.

2. An ice axe as defined in claim 1, wherein the ratio of the short dimension to the long dimension of the cross section of the working end of the shaft is in the range of 1:1.3 to 1:1.6.

3. An ice axe as defined in claim 1, wherein the short dimension of the cross section of the working end of the shaft is in the range of 0.75 inches to 1.00 inches, and the long dimension of the cross section of the working end of the shaft is in the range of 1.1 inches to 1.5 inches.

4. An ice axe as defined in claim 1, further comprising irregularities formed in an outer surface of the gripping end of the shaft and in an outer surface of the working end of the handle, said irregularities formed so as to engage the grip and the axe head respectively to enhance bonding of the grip to the gripping end of the shaft and of the axe head to the working end of the shaft.

5. An ice axe as defined in claim 4, wherein the irregularities comprise at least one groove formed circumferentially in the surface of the working end and at least one groove formed circumferentially in the surface of the gripping end of the shaft.

6. An ice axe as defined in claim 1, wherein said axe head includes:

a hammer end and a pick end disposed oppositely of the hammer end;

said hammer end having a striking surface facing transversely of the shaft and a bottom side directed generally toward the handle, with said bottom side being formed with a sharp edge.

7. An ice axe comprising:

a handle shaft having a gripping end and a working end;

an axe head attached to the working end of the handle shaft and configured for use as an ice axe;

said axe head having a hammer end and a pick end, said hammer end having a striking surface which is generally parallel with the handle shaft, and a bottom side disposed to generally face in the direction of the handle shaft, said bottom side being formed with a sharp edge which extends generally transversely of the axe head and the handle shaft.

8. An ice axe as defined in claim 7, wherein the bottom side of the hammer end is formed with the sharp edge at the intersection of the striking surface and the bottom side of the hammer end.

9. An ice axe as defined in claim 7, wherein the bottom side of the hammer end is formed with the sharp edge rearwardly of the intersection of the striking surface and the bottom side of the hammer end.

10. An ice axe as defined in claim 7, wherein the bottom side of the hammer end is formed with a sharp point.

11. An ice axe as defined in claim 7, wherein said gripping end of the handle shaft further comprises a cross section having a long dimension and a short dimension transverse thereof, said long dimension being oriented generally parallel to the plane in which the axe would be swung when used; and wherein said working end of the handle shaft further comprises a cross section having a long dimension and a short dimension transverse thereof, the short dimension of the working end being oriented parallel to said plane.

12. An ice axe as defined in claim 7, further comprising:

irregularities formed in an outer surface of the gripping end of the handle shaft and in an outer surface of the working end of the handle shaft for receiving and engaging a grip and the axe head respectively.

* * * * *